US010816277B2

(12) United States Patent
Dziubinschi et al.

(10) Patent No.: US 10,816,277 B2
(45) Date of Patent: Oct. 27, 2020

(54) HEAT EXCHANGER TUBES WITH FLUID COMMUNICATION CHANNELS

(71) Applicant: HALLA VISTEON CLIMATE CONTROL CORP., Daejeon-si (KR)

(72) Inventors: Orest Alexandru Dziubinschi, Dearborn, MI (US); Kastriot Shaska, Northville, MI (US); Brian James Cardwell, Ypsilanti, MI (US)

(73) Assignee: HANON SYSTEMS, Daejeon-si (KR)

( * ) Notice: Subject to any disclaimer, the term of this patent is extended or adjusted under 35 U.S.C. 154(b) by 864 days.

(21) Appl. No.: 14/336,211

(22) Filed: Jul. 21, 2014

(65) Prior Publication Data

US 2016/0018167 A1 Jan. 21, 2016

(51) Int. Cl.

| | |
|---|---|
| ***F28F 1/02*** | (2006.01) |
| ***F28F 3/04*** | (2006.01) |
| ***F28D 1/03*** | (2006.01) |

(52) U.S. Cl.

CPC ..... *F28F 1/022* (2013.01); *F28D 1/0391* (2013.01); *F28F 3/044* (2013.01)

(58) Field of Classification Search

CPC .... F28F 3/044; F28F 1/422; F28F 1/40; F28F 2001/027; F28F 1/426; F28D 1/0391

USPC ..... 165/179

See application file for complete search history.

(56) References Cited

U.S. PATENT DOCUMENTS

| | | | | |
|---|---|---|---|---|
| 5,762,133 | A | 6/1998 | Dion | |
| 6,073,688 | A * | 6/2000 | Kato | B21C 37/151 165/173 |
| 6,453,988 | B1 * | 9/2002 | Nakado | F28D 1/0391 165/152 |
| 6,575,232 | B1 * | 6/2003 | Nakado | F28D 1/0391 165/173 |
| 2004/0069477 | A1 * | 4/2004 | Nishikawa | F28D 1/0391 165/175 |
| 2005/0081379 | A1 * | 4/2005 | Askani | B21C 37/158 29/890.053 |

(Continued)

FOREIGN PATENT DOCUMENTS

| | | |
|---|---|---|
| CN | 1337562 A | 2/2002 |
| DE | 102008007597 A1 | 8/2009 |

(Continued)

OTHER PUBLICATIONS

English Translation of JP2000205783A.*

*Primary Examiner* — David J Teitelbaum
*Assistant Examiner* — Schyler S Sanks
(74) *Attorney, Agent, or Firm* — Shumaker, Loop & Kendrick, LLP; James D. Miller

(57) ABSTRACT

A tube for use in a heat exchanger comprises a first portion spaced apart from a second portion. At least one reinforcing structure having a non-circular cross-sectional shape extends between the first portion and the second portion to divide a flow of a fluid through the tube into a first flow channel to one side of the at least one reinforcing structure and a second flow channel to a second side of the at least one reinforcing structure. A fluid communication channel provides fluid communication between the first flow channel and the second flow channel. The fluid communication channel is at least one of a) formed through the at least one reinforcing structure and b) formed between two adjacent ones of the reinforcing structures.

10 Claims, 4 Drawing Sheets

(56) References Cited

U.S. PATENT DOCUMENTS

| | | | | | |
|---|---|---|---|---|---|
| 2007/0107882 | A1* | 5/2007 | Geskes | ..... | F28F 1/40<br>165/109.1 |

FOREIGN PATENT DOCUMENTS

| | | | | | |
|---|---|---|---|---|---|
| EP | 1179719 | A2 | | 2/2002 | |
| JP | H09170890 | A | | 6/1997 | |
| JP | H09329397 | A | | 12/1997 | |
| JP | H11325651 | A | | 11/1999 | |
| JP | 2000205783 | A | * | 7/2000 | ..... F28D 1/0391 |
| JP | 2000234881 | A | | 8/2000 | |
| JP | 2001041675 | A | | 2/2001 | |
| JP | 2002098492 | A | | 4/2002 | |
| KR | 2019980030843 | A | | 8/1998 | |

* cited by examiner

HEAT EXCHANGER TUBES WITH FLUID COMMUNICATION CHANNELS

FIELD OF THE INVENTION

The invention relates to a heat exchanger, and more specifically to a heat exchanger including a flat tube having a reinforcing structure formed therein.

BACKGROUND OF THE INVENTION

Heat exchangers having folded flat tubes are well known in the art. Such heat exchangers typically include a plurality of the folded flat tubes spaced apart and arranged in parallel and extending between an inlet header and an outlet header. The inlet header receives a first fluid and distributes the first fluid flow amongst a plurality of flow paths formed in the flat tubes. The first fluid exchanges heat energy with a second fluid flowing through the spaces between adjacent ones of the flat tubes. The first fluid then enters the outlet header before exiting the heat exchanger.

One common construction of a folded flat tube includes folding a sheet of aluminum into a tubular structure and brazing or welding the resulting seam. This construction results in a flat tube having a width extending from one folded portion to an opposite folded portion that is substantially larger than a height of the flat tube, causing the flat tube to be susceptible to deformation in a central region thereof due to internal pressures experienced within the flat tube.

The current trend in modern heat exchanger tube construction focuses on reinforcing this central region by adding one or more folds within the central region of each of the flat tubes. A sheet of aluminum forming the flat tube is folded in a manner that causes each of the folded portions to abut an inner surface of the flat tube along a length thereof, causing the hollow interior of the flat tubes to be divided into numerous flow paths while also reinforcing the flat tube along selected regions. However, the folded flat tube construction presents an additional problem as the addition of independent flow channels may result in significant differences in temperature and flow characteristics between each of the flow channels. These differences can result in a shear stress being formed between the flow channels which can in turn result in the generation of a significant bending moment within the tube. Such bending moments can cause a reduction in the durability of the tubes during thermal cycle testing and may also lead to premature cracking and leakage.

It would therefore be desirable to produce a tube for use in a heat exchanger having a reinforced central region and fluid communication channels formed between adjacent flow paths formed within the tube.

SUMMARY OF THE INVENTION

Compatible and attuned with the present invention, a tube having a reinforcing structure and a fluid communication channel formed between adjacent flow paths formed therein has surprisingly been discovered.

In one embodiment of the invention, a tube for use in a heat exchanger comprises a first portion spaced apart from a second portion and at least one reinforcing structure extending between the first portion and the second portion to divide the tube into a first flow channel and a second flow channel. Each of the at least one reinforcing structures has a non-circular cross-sectional shape. A first fluid communication channel providing fluid communication between the first flow channel and the second flow channel is at least one of formed through the at least one reinforcing structure and fanned between two adjacent ones of the reinforcing structures.

In another embodiment of the invention, a heat exchanger comprises an inlet header, an outlet header, and a tube fluidly coupling the inlet header to the outlet header. The tube includes a first portion spaced apart from a second portion. A plurality of first projections extend from an interior surface of the first portion and a plurality of second projections extend from an interior surface of the second portion and each of the first projections is coupled to a corresponding one of the second projections to form a plurality of reinforcing structures within the tube. Each of the reinforcing structures has a non-circular cross-sectional shape.

In another embodiment of the invention, a tube for use in a heat exchanger comprises a reinforcing structure extending along a length of the tube, wherein the reinforcing structure is formed by bending two opposing edges of a sheet forming the tube to contact each other at a substantially planar portion of the sheet formed intermediate the opposing edges. An aperture is formed adjacent each of the opposing edges and the reinforcing structure divides a flow of fluid through the tube into a first flow channel and a second flow channel. The apertures formed adjacent the opposing edges are aligned to form a fluid communication channel fluidly coupling the first flow channel to the second flow channel.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
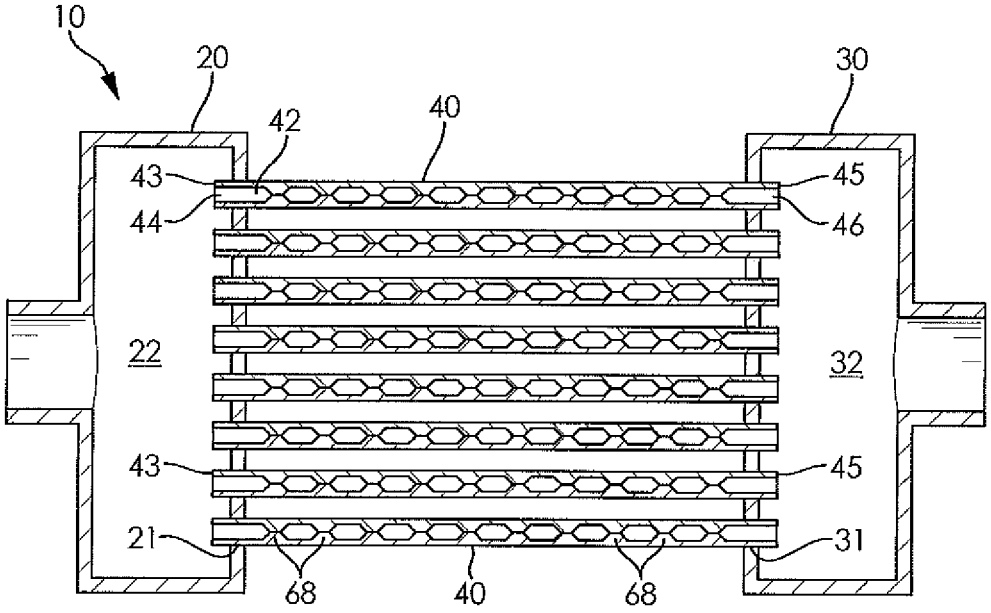
FIG. 1 is a cross-sectional elevational view of a heat exchanger according to an embodiment of the invention.

FIG. 1 illustrates a heat exchanger 10 according to an embodiment of the invention. The heat exchanger 10 may be used for any suitable application, including forming a component of a cooling system for an engine or a component of an air conditioning system, as non-limiting examples. The heat exchanger 10 may include an inlet header 20, an outlet header 30, and a plurality of tubes 40 extending between the inlet header 20 and the outlet header 30. Each of the inlet header 20 and the outlet header 30 of the heat exchanger 10 may have any suitable shape and structure to fluidly couple each of the tubes 40 thereto. The heat exchanger 10 may include a plurality of headers each having the tubes 40 extending therebetween without departing from the scope of the invention.

Each of the tubes 40 includes a hollow interior 42 extending from an open first end 43 thereof to an open second end 45 thereof. The open first end 43 of each of the tubes 40 acts as a fluid inlet 44 and the open second end 45 of each of the tubes 40 acts as a fluid outlet 46. The fluid inlet 44 fluidly couples the hollow interior 42 of each of the tubes 40 to a hollow interior 22 of the inlet header 20 and the fluid outlet 46 fluidly couples the hollow interior 42 of each of the tubes 40 to a hollow interior 32 of the outlet header 30.

Figure 2:
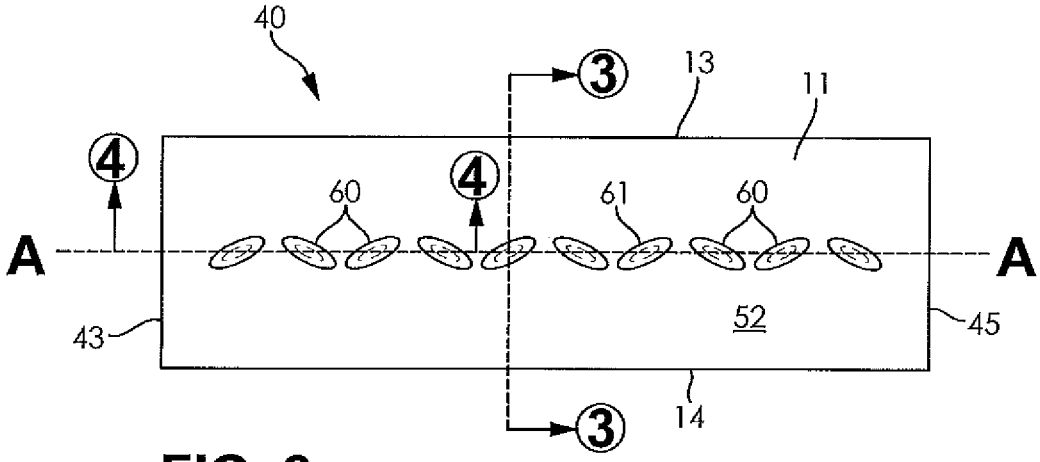
FIG. 2 is a top plan view of a heat exchanger tube for use in the heat exchanger illustrated in FIG. 1.
Figure 3:
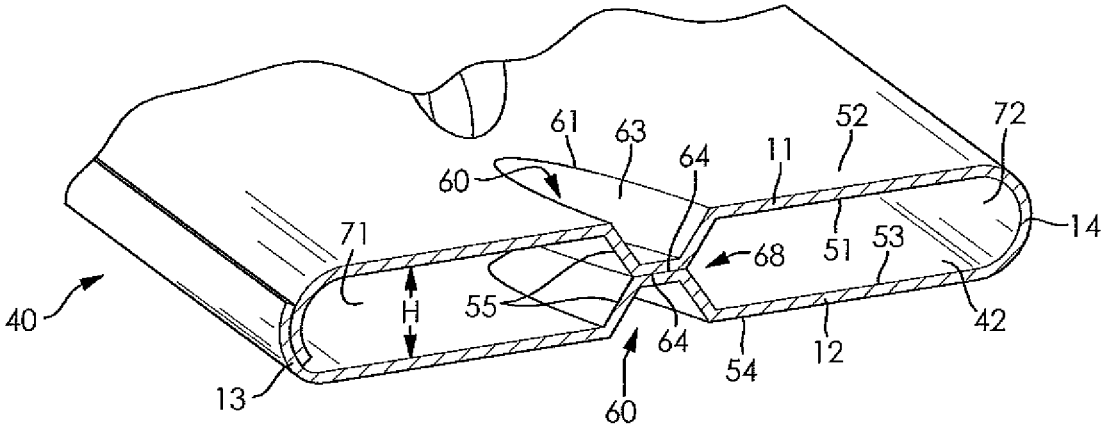
FIG. 3 is a fragmentary perspective view of an end of the heat exchanger tube illustrated in FIG. 2 showing a pair of flow channels formed within the heat exchanger tube.
Figure 4:
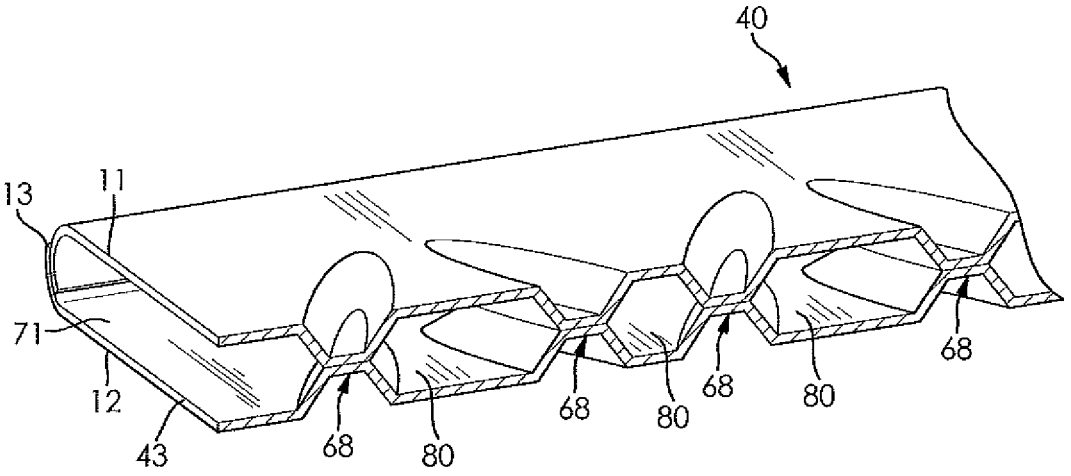
FIG. 4 is a fragmentary perspective view of the heat exchanger tube illustrated in FIG. 3 showing fluid communication channels for providing fluid communication between the flow channels formed within the heat exchanger tubes.

FIGS. 2-4 illustrate one of the tubes 40 forming the heat exchanger 10. As best shown in FIG. 3, the tube 40 is formed from a first major portion 11, a second major portion 12, a first side portion 13, and a second side portion 14. The first major portion 11 and the second major portion 12 are spaced apart from each other by a distance H representing a height of the tube 40 and are arranged substantially parallel to each other. The first major portion 11 and the second major portion 12 are each substantially planar. The first side portion 13 connects the first major portion 11 to the second major portion 12 at a first side of the tube 40 while the second side portion 14 connects the first major portion 11 to the second major portion 12 at a second side of the tube 40. The first side portion 13 and the second side portion 14 may be substantially arcuate in shape, but any suitable shape'may be used while remaining within the scope of the current invention, including a linear side portion formed from two bends at each end thereof, for example. The first major portion 11 includes an interior surface 51 facing toward the second major portion 12 of the tube 40 and an exterior surface 52 facing away from the second major portion 12 of the tube 40. The second major portion 12 includes an interior surface 53 facing toward the first major portion 11 of the tube 40 and an exterior surface 54 facing away from the first major portion 11.

Referring now to FIG. 2, the exterior surface 52 of the first major portion 11 of the tube 40 includes an array of dimples 60 formed therein. The dimples 60 are formed in the exterior surface 52 intermediate the first side portion 13 and the second side portion 14 of the tube 40. In some embodiments, each of the dimples 60 forming the array is arranged along and at least partially overlapping a centerline A of the tube 40, where the centerline A is equally spaced from each of the first side portion 13 and the second side portion 14. Each of the dimples 60 is shown as being substantially elliptical in shape, but any suitable shape may be used, including circular, rectangular, and arcuate, for example.

As shown in FIG. 2, a major axis of each of the elliptical dimples 60 may be angled with respect to the centerline A. The dimples 60 may also be angled with respect to the centerline A in alternating fashion to form a saw-tooth pattern. For instance, if a major axis of one of the elliptical dimples 60 formed in the exterior surface 52 of the first major portion 11 of the tube 40 is rotated about 30° in a clockwise direction relative to the centerline A when viewed from above the exterior surface 52, an adjacent one of the dimples 60 may have a major axis rotated about 30° in a counter-clockwise direction relative to the centerline A. However, it should be understood that the angle of the major axis of each of the dimples 60 relative to the centerline A may be any suitable angle for creating a desired geometry of the hollow interior 42 of the tube 40, as desired.

The exterior surface 54 of the second major portion 12 of the tube 40 also includes an array of the dimples 60 formed therein. Each of the dimples 60 formed in the second major portion 12 is aligned with a corresponding dimple 60 formed in the first major portion 11. For instance, when the first major portion 11 is viewed from above as shown in FIG. 2, each of the dimples 60 formed in the second major portion 12 may include a peripheral edge 61 that is substantially aligned with a peripheral edge 61 of a corresponding dimple 60 formed in the first major portion 11.

Referring again to FIG. 3, each of the dimples 60 formed in the exterior surface 52 of the first major portion 11 causes a corresponding projection 55 having a corresponding size and shape to be formed in the interior surface 51 of the first major portion 11. Similarly, each of the dimples 60 formed in the exterior surface 54 of the second major portion 12 causes a corresponding projection 55 having a corresponding size and shape to be formed in the interior surface 53 of the second major portion 12. Each of the projections 55 includes a coupling surface 64 formed at an end thereof extending furthest into the hollow interior 42 of the tube 40. The coupling surface 64 may be arranged substantially parallel to each of the first major portion 11 and the second major portion 12. Although the coupling surfaces 64 are shown as being substantially planar and elliptical in FIGS. 3 and 4, it should be understood that each of the coupling surfaces 64 may instead be formed along a single edge or an apex of each of the projections 55, for example. The peripheral edge 61 of each of the dimples 60, and hence each of the projections 55, is connected to the coupling surface 64 thereof by a sloped portion 63 extending around a circumference of the coupling surface 64. The sloped portion 63 of each of the dimples 60 is shown as being substantially linear and being angled at about 45° relative to the interior surfaces 51, 53, but it should be understood that the sloped portion 63 may have a curvilinear shape and may have any pitch, including being arranged perpendicular to the interior surfaces 51, 53, as desired. Each of the interior surface 51 of the first major portion 11 and the interior surface 53 of the second major portion 12 are spaced from the coupling surface 64 by a distance of about half the height H of the tube 40. It should be understood that the size and shape of the coupling surface 64 of each of the projections 55 may be dependent on the size and shape of the peripheral edge 61 of each of the dimples 60 as well as the pitch and shape of the sloped portion 63.

The coupling surface 64 of each of the projections 55 formed in the first major portion 11 of the tube 40 abuts and is coupled to a coupling surface 64 formed in a corresponding projection 55 formed in the second major portion 12 of the tube 40. Due to the manner in which the dimples 60 formed in the first major portion 11 are substantially aligned with the dimples 60 formed in the second major portion 12, the coupling surfaces 64 of the corresponding projections 55 may also be substantially aligned. The coupling surfaces 64 may be coupled to each other by any method known in the art such as brazing, welding, or bonding, as non-limiting examples. The coupling may be performed about an entirety of a perimeter of each of the coupling surfaces 64 to create a fluid tight seal between the corresponding projections 55.

The coupling of the corresponding projections 55 extending from each of the first major portion 11 and the second major portion 12 creates a plurality of reinforcing structures 68 extending therebetween. Each of the reinforcing structures 68 may have a substantially hour-glass appearance due to the presence of the sloped portions 63, but it should be understood that the reinforcing structures 68 may have any shape without departing from the scope of the current invention. Because of the elongated elliptical shape of each of the dimples 60, each of the reinforcing structures 68 will have an elliptical cross-section as each of the reinforcing structures 68 extend between the first major portion 11 and the second major portion 12. The elongated elliptical cross-sectional shape of the reinforcing structures 68 advantageously allows for a fluid flowing through each of the tubes 40 to be divided to each side of each of the reinforcing structures 68 without undergoing a substantial pressure drop due to the shape and curvature of the leading edge of each of the reinforcing structures 68 being somewhat pointed and oriented in a direction extending along a longitudinal axis of each of the tubes 40.

The reinforcing structures 68 substantially divide a flow of a fluid through the tube 40 into a first flow channel 71 formed to one side of the reinforcing structures 68 and adjacent the first side portion 13 and a second flow channel 72 formed to the other side of the reinforcing structures 68 and adjacent the second side portion 14. However, as best shown in FIG. 4, a plurality of fluid communication channels 80 is formed between adjacent ones of the reinforcing structures 68 due to a spacing formed between adjacent ones of the projections 55. The fluid communication channels 80 provide fluid communication between the first flow channel 71 and the second flow channel 72. If the substantially elliptical dimples 60 each include a major axis that is rotated relative to the centerline A, the fluid communication channels 80 may widen or narrow as the each of the fluid communication channels 80 extends in a direction from the first flow channel 71 to the second flow channel 72. Each of the fluid communication channels 80 may have a substantially hexagonal cross-sectional shape, with the interior surfaces 51, 53 forming two opposing edges of each of the fluid communication channels 80 and the sloped portions 63 forming the remaining four edges. It should be understood, however, that the cross-sectional shape of each of the fluid communication channels 80 may be affected by the size and orientation of the dimples 60 as well as the pitch of the sloped portions 63 thereof.

Figure 5:
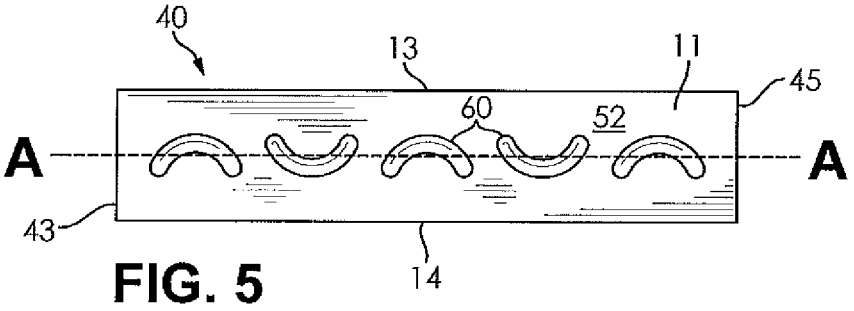
FIG. 5 is a top plan view of a heat exchanger tube according to another embodiment of the invention having an array of arcuate dimples formed therein.
Figure 6:
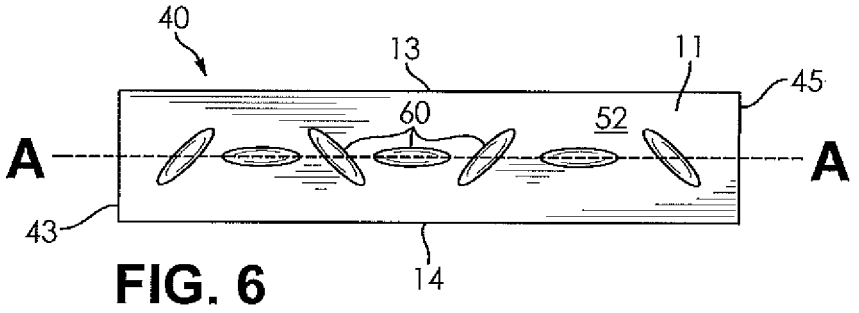
FIG. 6 is a top plan view of a heat exchanger tube according to another embodiment of the invention having an array of angled and linear dimples formed therein.
Figure 7:
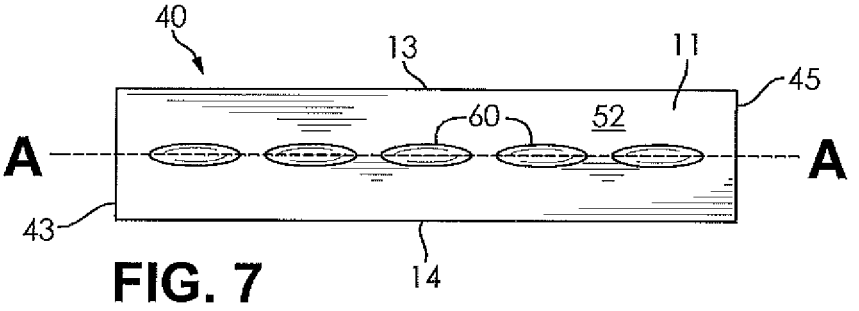
FIG. 7 is a top plan view of a heat exchanger tube according to another embodiment of the invention having an array of elliptical dimples formed therein and extending in a direction parallel to a length of the heat exchanger tube.

Referring now to FIGS. 5-7, several alternative arrangements of the dimples 60, and hence the projections 55 and the reinforcing structures 68, are shown. The dimples 60 are shown as being formed in the exterior surface 52 of the first major portion 11 of the tube 40, but it should be understood that the tube 40 also includes corresponding dimples 60 formed in the exterior surface 54 of the second major portion 12 and aligned with the dimples 60 formed in the first major portion 11 in similar fashion to the tube 40 shown and described in FIGS. 1-4.

FIG. 5 shows an arrangement including dimples 60 that are substantially arcuate in shape. The arcuate dimples 60 may be arranged in alternating fashion wherein a convex portion of one arcuate dimple 60 faces toward the first side portion 13 of the tube 40 and a convex portion of an adjacent arcuate dimple 60 faces toward the second side portion 14 of the tube 40. The arcuate dimples 60 may have any radius of curvature and may extend about any suitable angle. A size, shape, and spacing of the arcuate dimples 60 may be selected to provide for desirable flow characteristics through the hollow interior 42 of the tube 40.

FIG. 6 shows an arrangement including substantially elliptical dimples 60 that are oriented to be both parallel and angled with respect to the centerline A of the tube 40. Each of the dimples 60 having a major axis extending in the direction of the centerline A is formed adjacent a first dimple 60 rotated at an angle in a clockwise direction relative to the centerline A and a second dimple 60 rotated at an angle in a counter-clockwise direction relative to the centerline A. The angle at which the dimples 60 are rotated relative to the centerline A and a spacing between adjacent dimples 60 may be selected to provide for desirable flow characteristics through the hollow interior 42 of the tube 40.

FIG. 7 shows an arrangement where the major axis of each of the elliptical dimples 60 extends in the direction of the centerline A and each of the dimples 60 is arranged linearly with respect to each other. The dimples 60 are spaced from each other to allow for the creation of the fluid communication channels 80 between the resulting reinforcing structures 68.

Referring back to FIG. 1, the open first end 43 of the tube 40 may extend through an opening 21 formed in the inlet header 20 and into the hollow interior 22 thereof and the open second end 45 of the tube 40 may extend through an opening 31 formed in the outlet header 30 and into the hollow interior 32 thereof. The tube 40 may be coupled to each of the inlet header 20 and the outlet header 30 by any known means, including welding and brazing, as non-limiting examples. The coupling means may be applied at an interface of the tube 40 and each of the opening 21 formed in the inlet header 20 and the opening 31 formed in the outlet header 30. As should be understood, the reinforcing structures 68 are not formed in the tube 40 at the interface of the tube 40 and the openings 21, 31.

The reinforcing structure 68 formed closest to the first end 43 of the tube 40, and hence the fluid inlet 44 thereof, may be formed at a distance of at least zero to six times the height H of the tube 40 from the first end 43 thereof. The spacing of the first reinforcing structure 68 from the fluid inlet 44 of the tube 40 facilitates a more even fluid flow into the tube 40 adjacent the fluid inlet 44. The reinforcing structure 68 formed closest to the first end 43 of the tube 40 may also be spaced at a distance of at least zero to five times the height H of the tube 40 from the interface of the tube 40 and the opening 21 formed in the inlet header 20 to facilitate a strengthening of the tube 40 and to minimize an occurrence of overstressing along the centerline A of the tube 40 due to internal pressures and thermal loads experienced within the tube 40. Similarly, the reinforcing structure 68 formed closest to the second end 45 of the tube 40, and hence the fluid outlet 46 thereof, may also be spaced at a distance of at least zero to five times the height H of the tube 40 from the interface of the tube 40 and the opening 31 formed in the outlet header 30.

In use, a first fluid enters the inlet header 20 and is distributed to each of the tubes 40 via the fluid inlet 44 formed at the first end 43 thereof. The first fluid flows through the hollow interior 42 of each of the tubes 40 before encountering the reinforcing structures 68 formed therein. Upon encountering the reinforcing structures 68, a first portion of the flow of the first fluid flows through the first flow channel 71 to one side of the reinforcing structure 68 and a second portion of the flow of the first fluid flows through the second flow channel 72 to a second side of the reinforcing structure 68. The first fluid flow encountering each of the reinforcing structures 68 also increases a turbulence of the first fluid flow, thereby increasing the capacity for the first fluid to exchange heat with a second fluid flowing around an exterior of each of the tubes 40.

The fluid communication channels 80 formed between adjacent ones of the reinforcing structures 68 allow the flow of the first fluid in the first flow channel 71 to communicate with and mix with the flow of the first fluid in the second flow channel 72. As a result, the first fluid is prevented from developing a substantial temperature gradient between adjacent regions of the hollow interior 42 of each of the tubes 40, minimizing an occurrence of localized thermal stresses within each of the tubes 40. Additionally, the presence of the reinforcing structures 68 may provide for improved mixing, turbulence, and vortex flow of the first fluid as the first fluid encounters the reinforcing structures 68 to improve the heat exchange characteristics of the first fluid. The resulting flow of the first fluid exchanges heat energy through the walls of each of the tubes 40 with a flow of the second fluid flowing between adjacent ones of the tubes 40. The first fluid then exits each of the tubes 40 where the first fluid recombines in the outlet header 30 before exiting the heat exchanger 10.

As described hereinabove, the size, shape, and arrangement of the dimples 60 and hence the reinforcing structures 68 is selected to provide for desirable flow characteristics within the hollow interior 42 of each of the tubes 40. For example, referring to FIGS. 2-4, the alternating pattern of the elliptically shaped and angled reinforcing structures 68 aids in promoting fluid mixing between the first flow channel 71 and the second flow channel 72 by causing the first fluid to be diverted into a direction that is angled with respect to a length of each of the tubes 40. The angled flow of the first fluid is directed toward each of the first side portion 13 and the second side portion 14 of each of the tubes 40 due to the alternating pattern of the elliptically shaped reinforcing structures 68. The angled flow caused by the reinforcing structures 68 causes the first fluid to mix throughout the hollow interior 42 of each of the tubes 40 to further promote heat exchange with the second fluid. Additionally, the manner in which the fluid communication channels 80 are formed to widen and narrow as each fluid communication channel 80 extends from the first side portion 13 to the second side portion 14 may also promote the mixing of the first fluid, as slight pressure differences may occur between the first flow channel 71 and the second flow channel 72 adjacent each of the fluid communication channels 80. Such a pressure difference further aids in causing the first flow channel 71 and the second flow channel 72 to mix after the first fluid flow is divided by one of the reinforcing structures 68.

The reinforcing structures 68 also prevent an occurrence of outward bowing of each of the tubes 40 along or adjacent the centerline A thereof due to internal pressures formed within each of the tubes 40. Accordingly, the reinforcing structures 68 may beneficially be formed adjacent or overlapping the centerline A of each of the tubes 40. As described hereinabove, the coupling of corresponding projections 55 is performed about a perimeter of each of the abutting coupling surfaces 64 to form a single one of the reinforcing structures 68. A combined length of the perimeters of all of the mating coupling surfaces 64 formed in a single tube 40 may accordingly be chosen to be greater than a length of each of the tubes 40 measured from the first end 43 thereof to the second end thereof 45. The combined length of the coupled perimeters being greater than the length of each of the tubes 40 allows for the tube 40 having the reinforcing structures 68 to provide for greater strength than a traditional elongated tube having a single seam extending along a length thereof. Furthermore, a number, orientation, and geometry of the reinforcing structures 68 may be selected to impart desirable heat exchange and flow characteristics to the first fluid while preventing an excessive pressure drop within the first fluid as it flows along a length of each of the tubes 40.

Each of the tubes 40 may be formed from a sheet of any suitable material having suitable strength and thermal conductivity to withstand any internal pressures within each of the tubes 40 and to efficiently conduct heat energy between the first fluid flowing within each of the tubes 40 and the second fluid flowing around each of the tubes 40. Additionally, the material may be selected to ensure that each of the tubes 40 may be easily coupled to each of the inlet header 20 and the outlet header 30 by a suitable coupling means, such as brazing. The sheet of material may for instance have an aluminium base that is clad with an aluminium-based braze alloy on both sides.

The sheet may begin as a substantially planar sheet before being formed into each of the first major portion 11, the second major portion 12, the first side portion 13, and the second side portion 14 when bent into the shape shown in FIG. 3. Alternatively, each of the opposing edges of the sheet forming one of the first side portion 13 and the second side portion 14 may be pre-formed to have a suitable curvature and only a central region of the sheet may be substantially planar, for example. The substantially planar portion of the sheet may include two arrays of the dimples 60 formed therein and extending along a length of the sheet. The two distinct arrays of the dimples 60 are formed to be spaced apart and substantially symmetric about a line of symmetry extending along a length of the sheet and disposed at a substantially equal distance from each of the arrays of dimples 60. The sheet is caused to fold about the line of symmetry until the bent portion formed at the fold line thereof forms one of the first side portion 13 and the second side portion 14 of the tube 40. It should be understood that the one of the first side portion 13 and the second side portion 14 may be substantially arcuate in shape due to the formation of a single bend or may include two or more bends, as desired, so long as the dimples 60 of one array are aligned with the dimples 60 of the other array following the creation of the one of the first side portion 13 and the second side portion 14. The first major portion 11 and the second major portion 12 are then arranged parallel to each other wherein the projections 55 corresponding to the dimples 60 formed in one of the arrays and extending from the first major portion 11 are aligned with and abut the projections 55 corresponding to the dimples 60 formed in the other array and extending from the second major portion 12. The coupling surface 64 of each of the projections 55 extending from the first major portion 11 may be substantially aligned along the perimeter thereof with the coupling surface 64 of each of the corresponding projections 55 extending from the second major surface 12 to allow a coupling means to be applied thereabout such as brazing, as a non-limiting example. Once coupled, the projections 55 form the plurality of reinforcing structures 68 extending substantially along the centerline A of each of the tubes 40.

If brazing is used, the brazing may be applied to a portion or an entirety of the perimeter of the contacting coupling surfaces 64 forming each respective reinforcing structure 68. The brazing may be performed within the hollow interior 42 of each of the tubes 40 at the junction of each of the contacting projections 55. The hollow interior 42 of each of the tubes 40 may be accessed via one of the open first end 43 and the open second end 45 of each of the tubes 40. The use of interior brazing advantageously militates against an occurrence of leaking adjacent any of the reinforcing structures 68 because the braze alloy clad on the sheet forming each of the tubes 40 is drawn between two of the solid projections 55 instead of being applied at a seam separating an interior of the tube 40 from an exterior thereof. Accordingly, there is no risk of a fluid leaking into or out of the tube 40 if any of the surfaces brazed together within the hollow interior 42 of one of the tubes 40 become separated or otherwise fail.

Once the reinforcing structures 68 have been formed by coupling the projections 55, each of the tubes 40 is completed by forming the one of the first side portion 13 and the second side portion 14 that was not formed when the sheet was bent about the line of symmetry and then coupling the remaining edges of the sheet to each other. The forming of the remaining side portion 13, 14 may include bending at least one of the first major portion 11 and the second major portion 12 of the tube 40 toward the other. Accordingly, a remaining seam of each of the tubes 40 may be formed adjacent the one of the side portions 13, 14 not formed when the projections 55 are initially aligned with each other. The one of the side portions 13, 14 having the seam formed adjacent thereto may have a substantially arcuate shape due to a single bend being formed or may include two or more bends, as desired. The sheet may be coupled to itself along the remaining seam by any known means in the art including welding or brazing, as non-limiting examples. It should be understood that the seam formed along the length of each of the tubes 40 is not required to be formed adjacent one of the side portions 13, 14, and may be formed anywhere about a circumference of each of the tubes 40, as desired, so long as the reinforcing structures 68 are able to be formed in a suitable manner. Furthermore, the first side portion 13 is shown in FIGS. 3 and 4 as having an overlapping portion formed at the seam between the first major portion 11 and the second major portion 12. However, it should be understood that either of the first side portion 13 or the second side portion 14 may instead be formed by coupling the opposing edges of the sheet directly to each other without the occurrence of any overlap adjacent the seam without departing from the scope of the present invention.

The symmetric arrays of the dimples 60 formed in the sheet may be formed by any known method including stamping, for example. As described hereinabove, it may be beneficial to space the closest reinforcing structure 68 at a specified distance from the ends 43, 45 of each of the tubes 40. Accordingly, in some embodiments, it may be necessary to remove the dimples 60 from selected portions of the sheet by means of any suitable method such as an ironing process, to ensure that each of the resulting tubes 40 is devoid of the dimples 60 adjacent the ends 43, 45 thereof.

The tubes 40 have been described as having only a single row of the reinforcing structures 68 formed along a centerline A of each of the tubes 40. However, it should be understood that multiple rows of the reinforcing structures 68 may be formed by including additional rows of the dimples 60 that are positioned symmetrically about the line of symmetry in the sheets forming each of the tubes 40. Accordingly, the resulting hollow interior 42 of each of the tubes 40 may include flow channels in addition to the first and second flow channels 71, 72 as well as additional fluid communication channels 80 formed therebetween for providing fluid communication between all regions of the hollow interior 42 of each of the tubes 40.

Figure 8:
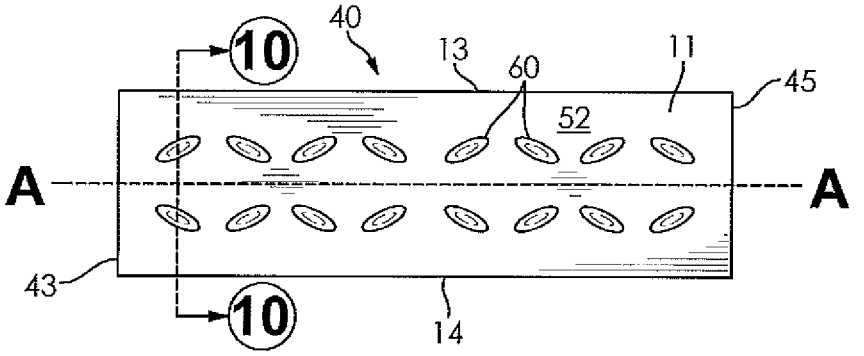
FIG. 8 is a top plan view of a heat exchanger tube according to another embodiment of the invention having a pair of linear arrays of dimples formed therein.
Figure 9:
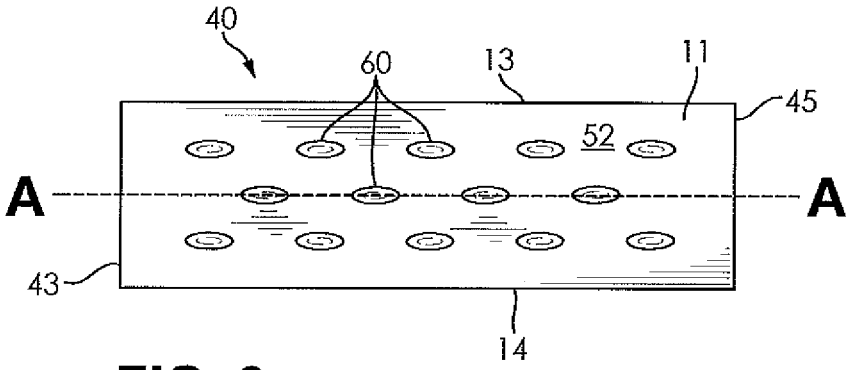
FIG. 9 is a top plan view of a heat exchanger tube according to another embodiment of the invention having three linear arrays of dimples formed therein.
Figure 10:
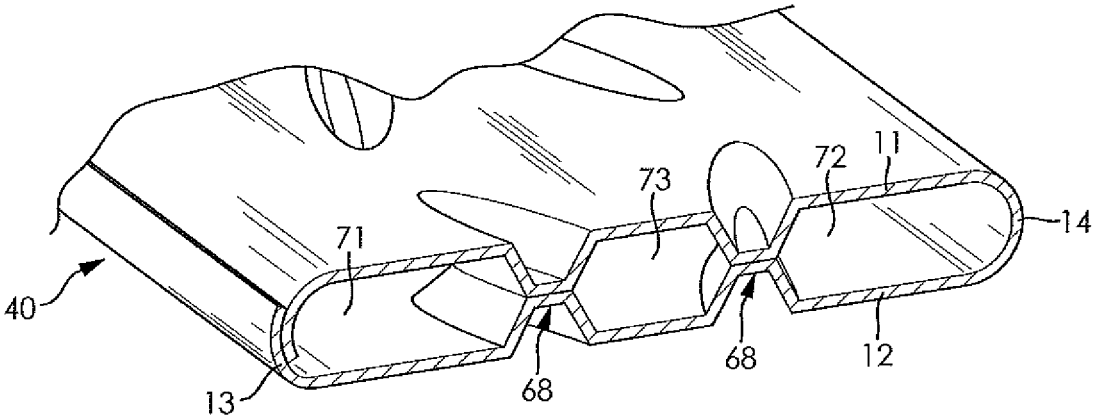
FIG. 10 is a fragmentary perspective view of the heat exchanger tube illustrated in FIG. 8 showing three flow channels formed within the heat exchanger tube.

FIGS. 8 and 9 illustrate non-limiting examples of tubes 40 including additional rows of the dimples 60 and the reinforcing structures 68. FIG. 8 illustrates a pair of rows of the dimples 60 formed in the exterior surface 52 of the first portion 11 of one of the tubes 40. Each of the rows of the dimples 60 is shown as having a pattern similar to that shown in FIG. 2, but it should be understood that each of the rows of the dimples 60 may have any suitable arrangement and pattern, including the arrangements shown and described in FIGS. 5-7. As shown in FIG. 10, the addition of a second row of the dimples 60 creates a third flow channel 73 in addition to the first flow channel 71 and the second flow channel 72 illustrated in FIG. 3. The third flow channel 73 may be in fluid communication with each of the first flow channel 71 and the second flow channel 72 via any of the fluid communication channels 80 formed between adjacent ones of the reinforcing structures 68. The addition of the third flow channel 73 may aid in mixing the fluid flowing through each of the tubes 40 and the addition of a second row of the reinforcing structures 68 may provide desirable structural advantages over the use of a single row of the reinforcing structures 68, including a greater resistance to bowing due to internal pressures within the tube 40 at selected regions within a hollow interior 42 of each of the tubes 40.

FIG. 9 illustrates three rows of the dimples 60 formed in the exterior surface 52 of the first portion 11 of one of the tubes 40. Each of the rows is shown as having an arrangement similar to that shown in FIG. 7, but it should be understood that any pattern of arrangement of the dimples 60 may be used for each of the rows, including the arrangements shown in FIGS. 2, 5 and 6, for example. The addition of the third row of dimples 60 also forms an additional flow channel (not shown) within the tube 40. The arrangement in FIG. 9 also includes a row of the dimples 60 that is offset relative to the other two rows of dimples 60. This offset arrangement may cause the formation of fluid communication channels 80 that cause fluid flow therethrough to be angled with respect to a length of the tube 40 in a manner that differs when compared to the fluid communication channels 80 illustrated in FIG. 4. The offset arrangement may be selected to create desirable fluid mixing within each of the tubes 40 or to minimize a pressure drop of the fluid as it flows through each of the tubes 40. It should be understood that any number of rows of the dimples 60, and hence the reinforcing structures 68, may be utilized in any number of arrangements while remaining within the scope of the current invention.

Figure 11:
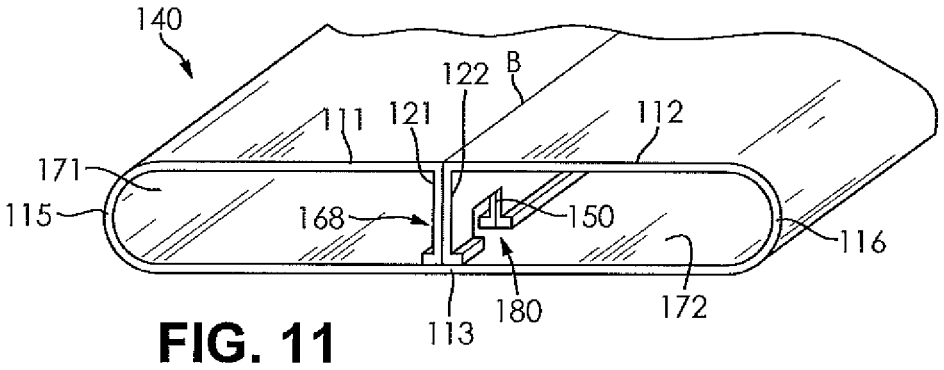
FIG. 11 is a fragmentary perspective view of a heat exchanger tube having a substantially B-shaped cross-section according to another embodiment of the invention.

FIG. 11 illustrates a tube 140 according to another embodiment of the invention. The tube 140 is formed from a sheet of material bent into a substantially B-shaped configuration. The sheet of material may be any material having suitable thermal conductivity and mechanical strength such as a double-sided clad aluminium sheet, as a non-limiting example. The B-shaped tube 140 includes a first planar portion 111 and a second planar portion 112 formed substantially co-planar to each other and spaced apart from a third planar portion 113 arranged in parallel to the first and second planar portions 111, 112. A first side portion 115 connects the first planar portion 111 to a first side of the third planar portion 113 and a second side portion 116 connects the second planar portion 112 to a second side of the third planar portion 113. Each of the first side portion 115 and the second side portion 116 may be substantially arcuate in shape or may include two or more bends formed therein without departing from the scope of the current invention.

The first planar portion 111 and the second planar portion 112 meet at a centerline B of the tube 140 equally spaced from each of the first side portion 115 and the second side portion 116. The first planar portion 111 of the tube 140 transitions into a first central portion 121 extending between the first planar portion 111 and the third planar portion 113 of the tube 140. The second planar portion 112 of the tube 140 transitions into a second central portion 122 extending between the second planar portion 112 and the third planar portion 113 of the tube 140. Portions of the first central portion 121 and the second central portion 122 facing each other may substantially abut each other as the first central portion 121 and the second central portion 122 extend to the third planar portion 113 of the tube 140, wherein the first central portion 121 may then bend outward toward the first side portion 115 and the second central portion 122 may then bend outward toward the second side portion 116. Alternatively, the first central portion 121 and the second central portion 122 may include folds of 180 degrees (not shown) formed adjacent the third planar portion 113 to double up each of the central portions 121, 122 for additional strength of the tube 140 along the centerline B. The first central portion 121 and the second central portion 122 combine to form a central reinforcing structure 168 extending along a length of the tube 140.

The first central portion 121 and the second central portion 122 may be coupled to each other using any known coupling method, such as welding or brazing, as non-limiting examples. The coupling means may be applied to the tube 140 along a centerline B where the first planar portion 111 meets the second planar portion 112. The coupling means may also be applied at a junction of the first central portion 121 and the second central portion 122 with the third planar portion 113. If brazing is used, the sheet of material forming each of the tubes 140 may be clad on one or both sides with a braze alloy. The sheet of material may have a base of aluminium and be clad with an aluminium based braze alloy, for example.

The sheet of material forming the B-shaped tube 140 may include two opposing edges, each having at least one slot 150 formed therein, wherein each of the slots 150 is arranged to meet and be aligned with a corresponding slot 150 adjacent the third planar portion 113 when the sheet is formed into the B-shape illustrated in FIG. 11. The aligning slots 150 form at least one fluid communication channel 180 providing fluid communication between a first flow channel 171 formed to one side of the central reinforcing structure 168 and a second flow channel 172 formed to a second side of the central reinforcing structure 168. Alternatively, in place of the slots 150 extending from opposing edges of the sheet forming the tube 140, the at least one fluid communication channel 180 may be formed by forming apertures (not shown) that are equally spaced from the opposing edges of the sheet such that the apertures will be aligned when the sheet is formed into the B-shape illustrated in FIG. 11.

In use, the first fluid enters each of the tubes 140 and is immediately divided into a first fluid stream in the first flow channel 171 and a second fluid stream in the second flow channel 172 as the first fluid encounters the reinforcing structure 168. The first fluid stream and the second fluid stream are then allowed to recombine when they encounter each of the fluid communication channels 180 formed by the slots 150. This mixing of the first and second fluid streams militates against the formation of substantial temperature gradients between different regions within each of the tubes 140 and especially between the first flow channel 171 and the second flow channel 172. The reinforcing structure 168 also reinforces the central portion of each of the tubes 140 to prevent an outward bowing due to internal pressures within each of the tubes 140.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A tube for use in a heat exchanger, the tube comprising:

a first portion spaced apart from a second portion, wherein each of the first portion and the second portion form at least a portion of an outer wall of the tube;

a plurality of reinforcing structures extending between the first portion and the second portion to divide the tube into a first flow channel and a second flow channel, wherein each of the reinforcing structures has a non-circular cross-sectional shape, wherein each of the reinforcing structures is angled with respect to each of a longitudinal axis of the tube and a transverse axis of the tube in alternating fashion to cause the reinforcing structures to be arranged in a saw-tooth pattern, wherein each of the reinforcing structures has a same size and a same shape, and wherein a center of each of the reinforcing structures is disposed on a single line extending parallel to the longitudinal axis of the tube, wherein each of the reinforcing structures has an elliptical cross-sectional shape, wherein a major axis of each of the reinforcing structures is angled with respect to the longitudinal axis of the tube in an alternating arrangment to form the saw tooth pattern, wherein a first one of the reinforcing structures is angled at 30 degrees with respect to the longitudinal axis and a second adjacent one of the reinforcing structures is angled at 30 degrees with respect to the longitudinal axis in a counter clockwise direction from the first one of the reinforcing structures, and wherein one of the reinforcing structures adjacent an end of the tube is spaced from the end of the tube; and a first fluid communication channel providing fluid communication between the first flow channel and the second flow channel, wherein the first fluid communication channel is formed between two adjacent ones of the reinforcing structures.

2. The tube according to claim 1, wherein a first projection extends from an interior surface of the first portion and a second projection extends from an interior surface of the second portion and the first projection and the second projection cooperate to form one of the reinforcing structures.

3. The tube according to claim 2, wherein a coupling surface of the first projection is aligned with and coupled to a coupling surface of the second projection.

4. The tube according to claim 3, wherein the coupling surface of the first projection is coupled to the coupling surface of the second projection by a brazing process performed within an interior of the tube.

5. The tube according to claim 4, wherein the brazing process is performed about a perimeter of each of the reinforcing structures where the coupling surfaces meet and a total combined length of the brazed perimeters of the reinforcing structures is greater than a length of the tube.

6. A heat exchanger comprising:

an inlet header;

an outlet header; and a tube fluidly coupling the inlet header to the outlet header, the tube including a first portion spaced apart from a second portion, wherein each of the first portion and the second portion form at least a portion of an outer wall of the tube, wherein a plurality of first projections extend from an interior surface of the first portion and a plurality of second projections extend from an interior surface of the second portion and each of the first projections is coupled to a corresponding one of the second projections to form a plurality of reinforcing structures within the tube, each of the reinforcing structures having a non-circular cross-sectional shape, wherein each of the reinforcing structures is angled with respect to each of the longitudinal axis of the tube and a transverse axis of the tube in alternating fashion to cause the reinforcing structures to be arranged in a saw-tooth pattern, wherein each of the reinforcing structures has a same size and a same shape, and wherein a center of each of the reinforcing structures is disposed on a single line extending parallel to the longitudinal axis of the tube, wherein the reinforcing structures are spaced from and disposed exterior to the inlet header and the outlet header.

7. The heat exchanger according to claim 6, wherein the tube has a first end coupled to the inlet header and a second end coupled to the outlet header and a first reinforcing structure encountered by a fluid flowing through the tube is spaced between 1 and 6 times a height of the tube from the first end of the tube and is spaced between 1 and 5 times the height of the tube from an interface of the tube and the inlet header.

8. The tube according to claim 1, wherein the saw-tooth pattern extends parallel to the longitudinal axis of the tube.

9. The heat exchanger according to claim 6, wherein the saw-tooth pattern extends parallel to the longitudinal axis of the tube.

10. The tube of claim 1, wherein the reinforcing structures are formed in a single column.

* * * * *